US005341535A

United States Patent [19]

O'Brien

[11] Patent Number: 5,341,535

[45] Date of Patent: Aug. 30, 1994

[54] WINDOW SCRAPER

[76] Inventor: George A. O'Brien, 384 Hollow Tree Ridge Rd., Darien, Conn. 06820

[21] Appl. No.: 41,701

[22] Filed: Apr. 1, 1993

Related U.S. Application Data

[63] Continuation-in-part of Ser. No. 768,389, Sep. 30, 1991, abandoned.

[51] Int. Cl.[5] ..... A46B 13/02; A47L 1/05

[52] U.S. Cl. ..... 15/22.4; 15/49.1; 15/93.1; 15/22.1

[58] Field of Search ..... 15/22.1, 22.2, 22.4, 15/23, 28, 93.1, 50.2, 52.2, 49.1, 50.1

[56] References Cited

U.S. PATENT DOCUMENTS

| | | | |
|---|---|---|---|
| 870,633 | 11/1907 | Lewis | 15/50.2 |
| 891,970 | 6/1908 | Askeli | 15/50.2 |
| 1,472,208 | 10/1923 | Dawer | 15/50.2 |
| 1,519,530 | 12/1924 | Chan | 15/50.2 |
| 2,238,993 | 4/1941 | Daniels | 15/22.4 |
| 2,918,685 | 12/1959 | Sundstrom | 15/23 |
| 3,118,162 | 1/1964 | Karr et al. | 15/28 |
| 3,196,473 | 7/1965 | Bell | 15/23 |
| 4,005,502 | 2/1977 | Stevens | 15/22.1 |
| 4,136,420 | 1/1979 | Cyphert | 15/50.2 |

OTHER PUBLICATIONS

Home & Shop Journal, Tool Test, Fein Finishing Sander, Popular Mechanics 1991.

*Primary Examiner*—Edward L. Roberts
*Attorney, Agent, or Firm*—John C. Andres

[57] ABSTRACT

A window scraper and method are provided wherein a scraping brush has filaments and wherein the tips of the filaments are moved linearly across the work surface as the brush rotates. Preferably, the brush has brass filaments trimmed to a point, and the brush drive mechanism moves the brush in an oscillating arcuate path while cams and cam surfaces simultaneously cause the brush to move toward and away from the work surface to maintain the tip of the filaments in substantially the same plane at a constant distance and pressure relative to the work surface. A novel brush has filaments trimmed to a point, an axle of rotation and cams to engage cam surfaces. The device includes an oscillating drive mechanism, a slot to rotatably and slidingly receive the brush axle, and cam surfaces to engage the brush cams and cause the brush axle to slide in the slot, causing the brush to move toward and away from the work surface during portions of the rotating brush sweep.

24 Claims, 10 Drawing Sheets

WINDOW SCRAPER

RELATED APPLICATIONS

The present application is a continuation-in-part of co-pending application Ser. No. 07/768,389 filed Sep. 30, 1991, now abandoned.

TECHNICAL FIELD

The present invention relates to an improved apparatus and method for removing dried paint and other unwanted substances from a surface such as a glass window pane.

BACKGROUND OF THE INVENTION

It is customary to paint window frames and mullions in order to protect the wood from the elements and seal glazing putty used to hold a window pane in place within the window frame. It is important to paint window glazing to prevent the glazing from drying out and cracking, which would compromise the seal formed by the glazing between the window frame and the pane. Compromising the seal can lead to inefficient air leakage and condensation formation, resulting in excess energy use and rotting of the wood frame.

In painting glazing and mullions, a painter attempts to minimize the amount of paint which accumulates on the glass itself. As with any painting process, however, a certain amount of paint is left on the window pane and must be removed. Attempts can be made to remove excess paint from the window before it dries, but this is difficult to do without damaging the undried paint applied to the glazing putty, mullions window frame. Regardless whether such attempts are made, it inevitably is necessary to remove dried paint from the glass window pane. The challenge in removing such dried paint is to remove the dried paint from the glass without affecting the paint on the glazing, mullions and window frame. Additionally, a small amount of paint should be left on the glass immediately adjacent the glazing and mullions to ensure a seal is formed between the glass and the wood or metal frame.

Heretofore, dried paint has been removed from window panes with razor blades held by hand or supported in some sort of handle. This method of removing dried paint from a window pane has numerous disadvantages. Such razor blade methods are time consuming, tedious and tiring. The user must establish and maintain the correct blade angle relative to the glass and apply enough pressure to remove the dried substances without scratching the glass. Maintaining the correct blade angle and pressure quickly causes fatigue in the worker's hands. Moreover, such manual methods require great care in working near painted mullions to avoid damaging the painted mullions, glazing or wood of the mullion or window. In this regard it is particularly difficult to remove paint from corners without nicking or scraping the glazing, mullions or window. As stated, an important reason for painting the window around the panes and at mullions is to paint over and seal window glazing and establish a seal at the juncture of the glazing and the window pane. However, the edge of the razor blade and razor blade scraper can cut into painted putty that is around the window, thereby causing premature drying of the putty which compromises the seal around the window pane. Even if the glazing or mullion isn't damaged, it is difficult if not impossible to prevent the razor blade from sliding under the window glazing and/or mullion, which also compromises the seal established by the paint. In the case of double-paned windows, sliding the blade under the mullion can compromise the seal between the panes, which is even more difficult to repair than damaged window glazing. In addition, working with exposed razor blades is hazardous and can lead to cuts during use or in changing blades. Further, if the blade or scraper is left out it can be a hazard to children.

Because there is no satisfactory method of quickly and reliably removing dried paint from a window pane, a painter generally paints more slowly around window panes in order to try not to leave any paint on the window, which inevitably occurs to some extent notwithstanding the degree of care exercised. In the end, the added care taken results in added time of the painter which translates into higher cost for the consumer. In the end, the painter must in any event remove dried paint from the window.

Various brushing or scrubbing devices have been proposed for a variety of purposes, but none are suitable for removing dried paint from a window pane. By way of example, U.S. Pat. Nos. 870,633 issued to Lewis, U.S. Pat. No. 891,970 issued to Askeli, and U.S. Pat. No. 1,472,208 issued to Dawer all disclose floor cleaning apparatus including a linearly reciprocating brush. In all of these patents the brush filaments remain in the same plane as it moves across the floor surface and returns, with the brush filaments substantially perpendicular to the floor throughout the brush sweep.

U.S. Pat. No. 1,519,530 issued to Chan discloses a polishing brush including receptacles for polishing liquids to be discharged to the brush through openings.

U.S. Pat. No. 2,918,685 issued to Sundstrom discloses a machine for removing hardened paint providing a heater means for softening hardened paint and a motor driven rotary brush positioned adjacent the heater means so that it abrades and brushes away the softened paint.

U.S. Pat. No. 3,118,162 issued to Karr discloses a rotary wire brush and a stabilizer for such a wire brush that are well suited for removing scale from the sheets and beads of steam boilers.

U.S. Pat. No. 3,196,473 issued to Bell discloses a grill cleaner having a power-operated rotary brush.

U.S. Pat. No. 4,005,502 issued to Stevens discloses an electric power scrubber which moves a brush in an oscillating back and forth rotary motion rather than the conventional rotary motion. The brush is generally triangular to fit into corners and other tight spots into which a circular brush cannot fit.

U.S. Pat. No. 4,136,420 issued to Cyphert discloses a carpet soil extracting wand having a powered brush which reciprocates through a predetermined arc to scrub the carpet. Bias means are included to allow variation in the pressure exerted by the reciprocating brush upon the pile of the carpet.

It has been found that planar reciprocating brushes or brushes reciprocating through a predetermined fixed arc are unsuitable for removing dried paint from a window pane adjacent mullions and into corners without marring painted mullions or glazing or scratching or otherwise marring the glass pane.

Accordingly, it is an object of the invention to provide an apparatus and method of removing unwanted dried substances, such as dried paint, from a work surface, such as glass, metal, plastic or wood, which is easy to use and saves time.

Another object of the invention is to provide an apparatus and method of removing unwanted dried substances, such as dried paint, from a work surface which involves little, if any, danger of injuring or cutting ones fingers.

Another object of the invention is to provide an apparatus and method of removing unwanted dried substances, such as dried paint, from a work surface which provides an even edge around a window closely adjacent the mullion.

Another object of the invention is to provide an apparatus and method of removing unwanted dried substances, such as dried paint, from a work surface which leaves a small and even strip of paint around a window pane that seals the mullion and glass where they come into contact, rather than removing all of the paint and even going under the mullion in some cases, as occurs with a razor blade.

Another object of the invention is to provide an apparatus and method of removing unwanted dried substances, such as dried paint, from a work surface which enables an operator to quickly and easily remove the paint from the corners of windows.

Another object of the invention is to provide an apparatus and method of removing unwanted dried substances, such as dried paint, from a work surface which has no sharp edges and will not scratch paint on mullions.

Another object of the invention is to provide an apparatus and method of removing unwanted dried substances, such as dried paint, from a work surface without cutting or gouging putty around the window.

Another object of the invention is to provide an apparatus and method of removing unwanted dried substances, such as dried paint, from a work surface which allows painters to paint faster knowing that excess paint can be quickly and easily removed from the windows, thus reducing costs to consumers.

Another object of the invention is to provide an apparatus and method of removing unwanted dried substances, such as dried paint, from a work surface which provides incentive for homeowners to paint their mullions, whereas before they would neglect painting the mullions because of the difficult and time consuming job of cleaning the windows with a razor blade.

Another object of the invention is to provide an apparatus and method of removing unwanted dried substances, such as dried paint, from a work surface which eliminates danger of children or others injuring themselves with a razor blade left out in the open or by reaching into a tool chest.

Another object of the invention is to provide an apparatus and method of removing unwanted dried substances, such as dried paint, from a work surface which will not puncture a double-paned window seal.

SUMMARY OF THE INVENTION

In accordance with the invention a hand held, powered scraping apparatus is provided having a brush which moves back and forth across the surface being treated. Constant pressure of the brush on the surface is maintained throughout the rotating back and forth sweep of the brush by moving the brush away from the surface during a portion of the arcuate sweep of the brush. In the preferred embodiment the brush has brass filaments and the tip of the brush is maintained parallel to the surface by camming the rotating brush away from the surface as the brush approaches the center of its arcuate sweep across the surface. The apparatus housing is constructed so that the movement of the brush filaments closely approach window mullions to remove paint or other substances closely adjacent mullions and in corners without damaging the mullion or associated putty and seal. The housing also acts to establish and define the relationship between the sweep of the brush and the surface of the window. The preferred brush is a brass filament brush having a teardrop or triangular cross-section coming to a relatively pointed tip. In use, the brush rotates back and forth while the tip of the brush is maintained parallel to the surface with the filaments contacting the surface under constant pressure throughout the sweep to remove dried paint and other substances without exerting undue force on the surface which might scratch or mar the surface.

In accordance with the method of the invention, the brush is rotated through a sweeping motion to remove paint from a window. During the rotating sweep, the brush is cammed away from the surface so that the tip of the brush moves across the window pane surface at a substantially constant distance and pressure without marring the surface. Because the tip of the brush moves across the surface with constant pressure and at a predetermined distance relative to the surface the brush reaches into corners and thoroughly removes dried paint to a point closely adjacent the mullions.

In a first embodiment, lower cams on the brush axle cam against a lower cam camming surface on the housing to variably urge the brush axis perpendicularly away from the surface. At the same time, upper cams on the brush axle engage upper camming surfaces on the housing to variably limit upward travel of the brush away from the surface. Thus, the upper and lower cams and camming surfaces cooperate to variably control the distance and pressure of the brush relative to the surface throughout the rotation of the brush. In an alternative embodiment, the upper cams and upper camming surface are replaced by a biasing spring which urges the brush downward toward the work surface in opposition to the action of a cam engaging a camming surface to variably urge the brush away from the surface during the brush rotation. Thus, the camming action together with the biasing spring variably control the distance and pressure of the brush relative to the work surface throughout the brush rotation.

As will be appreciated from the drawings and detailed description, the apparatus and method of the invention removes paint or other substances from a work surface without scratching the surface. In addition, the invention advantageously removes paint in and around window mullions without damaging painted mullions or putty or compromising the window seal. As yet a further advantage, the invention eliminates any need for a razor blade with its attendant disadvantages.

As used in the accompanying claims, the term "biasing means" refers to a cam or spring arrangement, or equivalent structures, acting upon the brush.

As used in the accompanying claims, the term "drive means" refers to a motor and an oscillating drive linkage.

As used in the accompanying claims, the term "camming means" refers to a cam and cam surface associated with the brush and housing.

BRIEF DESCRIPTION OF THE DRAWINGS

The accompanying drawings constitute a part of the disclosure and illustrate preferred embodiments of the invention.

DETAILED DESCRIPTION OF THE PREFERRED EMBODIMENTS

Figure 1:
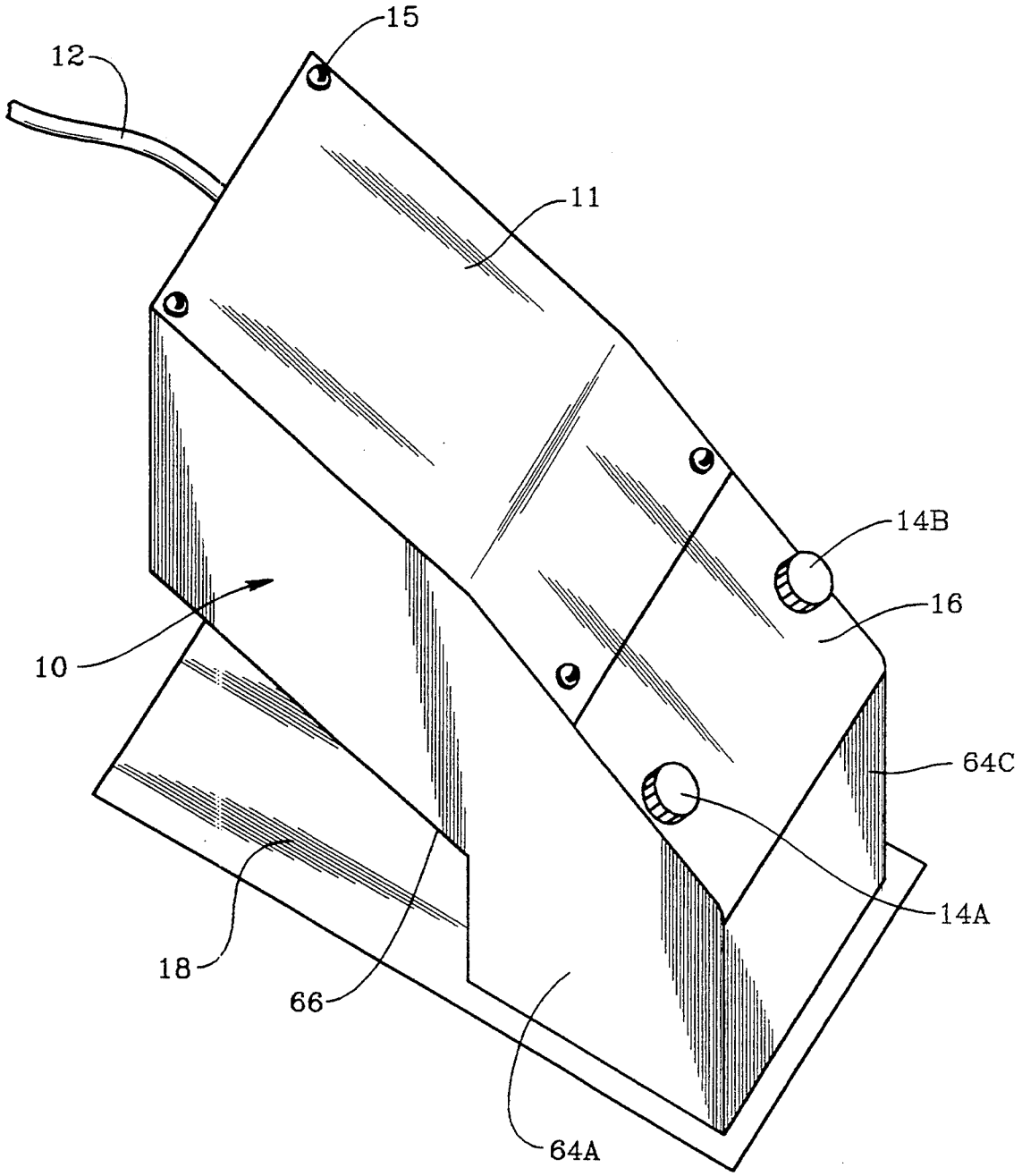
FIG. 1 is a perspective view of a first embodiment of the invention.

Referring now to the drawings, a first embodiment of the automated window scraper in accordance with the invention is illustrated in FIGS. 1–7.

Figure 2:
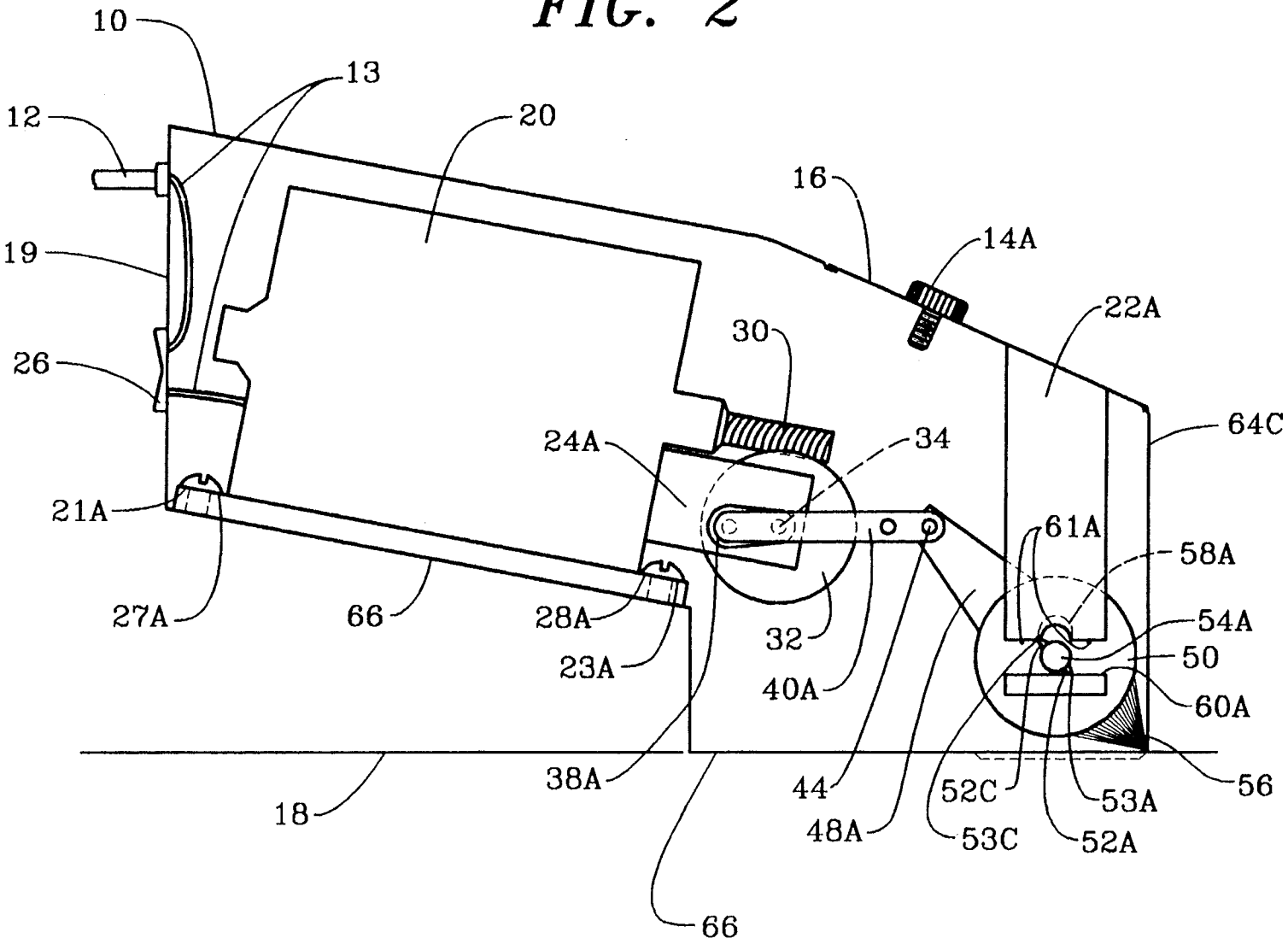
FIG. 2 is a sectional side view of the first embodiment of the invention.
Figure 5:
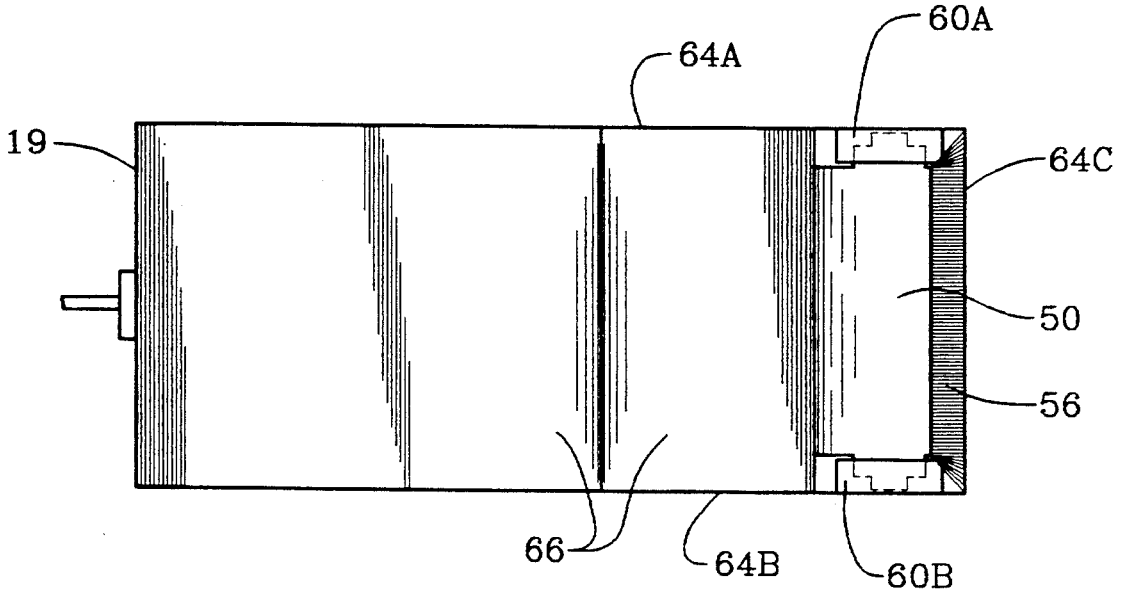
FIG. 5 is a bottom view of the first embodiment of the invention.

As shown in FIG. 1, a housing 10 has a front wall 64C, a rear wall 19 (FIG. 2), two sides 64A and 64B (FIG. 5) and a bottom 66 (FIGS. 2 and 5). Front wall 64C is perpendicular to a horizontal plane 18 representing the work surface and is approximately 65 mm wide and approximately 50 mm high. Rear wall 19, which is substantially parallel to the front wall 64C, begins approximately 38 mm above horizontal plane 18 and is approximately 60 mm high and 60 mm wide. Bottom 66 is approximately 60 mm wide, begins at the base of front wall 64C, goes back approximately 70 mm perpendicularly to front wall 64C, turns upward at about a 90° angle for approximately 20 mm, then turns toward rear wall 19 forming a straight line approximately 83 mm in length to the lowest part of rear wall 19. Sides 64A and 64B of housing 10, which are a mirror image of one another, connect front wall 64C, rear wall 19 and bottom 66. The shapes of the tops of side walls 64A and 64B can be drawn with a line from the top of rear wall 19, parallel to bottom 66 for approximately 95 mm, then downward for approximately 60 mm in a straight line to the top of front wall 64C. In the preferred embodiment horizontal plane 18 represents a glass surface, particularly a window pane.

Housing 10 preferably is molded or extruded in one piece. Alternatively, housing 10 may be made of separate parts assembled together by gluing, welding, bolting or other means.

Figure 6:
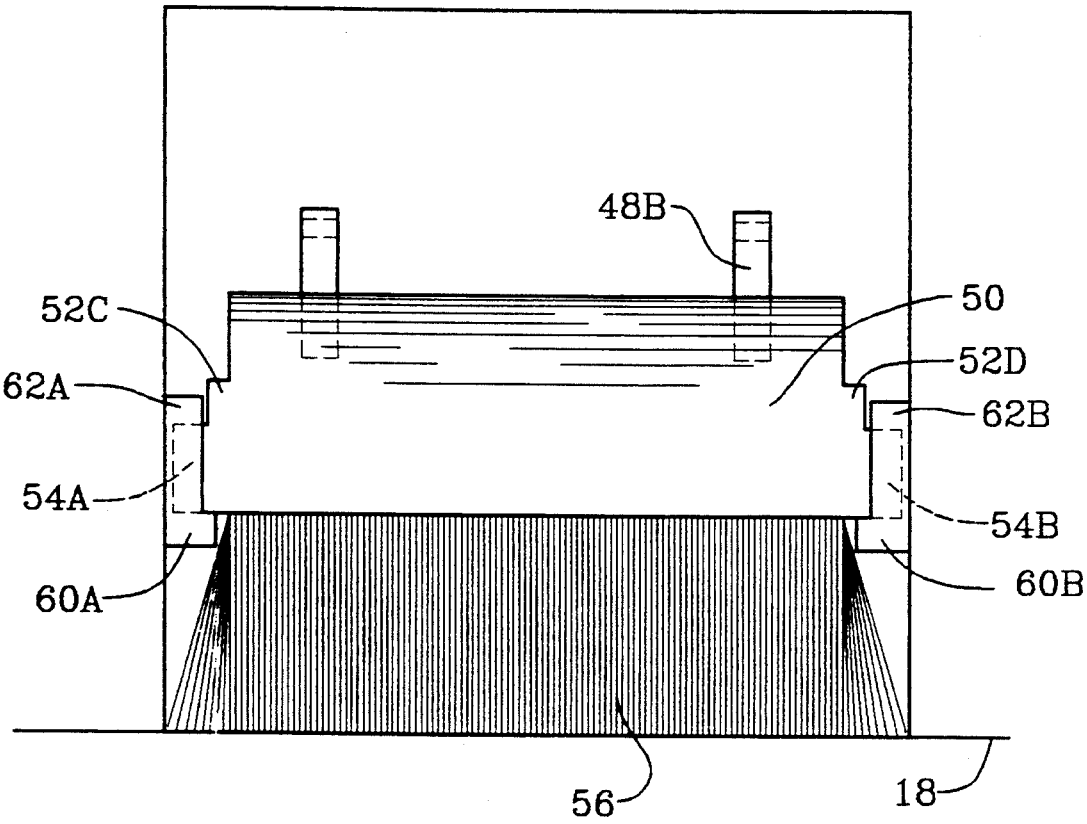
FIG. 6 is a sectional front view of the first embodiment of the invention.

A brush cover 16 is approximately 60 mm wide and 38 mm in length and sits above a brush 50 assembly (see FIG. 2). Cover 16, when in place, is contiguous to the tops of front wall 64C, side walls 64A and 64B and the edge of motor cover 11 that is closest to front wall 64C. The front edge of cover 16 that is connected to front wall 64C turns downward for approximately 4 mm and has a "U" shaped groove at that end which is approximately 60 mm long and forms the edge. Cover 16 may be made of the same material as housing 10. Cover 16 has two upper brush shaft suppressors 22A and 22B (FIGS. 2 and 3B) which preferably are formed integral with cover 16 at the outside edges of the cover. Shaft suppressors 22A and 22B are perpendicular to a horizontal plane 18, brush shaft suppressors 22A and 22B go straight down inside side walls 64A and 64B of housing 10. The bottom of the shaft suppressors are shaped to abut the top of brush shaft guides 62A (FIGS. 3A and 3B) and 62B (FIG. 4) as well as lower cam guides 60A (FIG. 3A) and 60B (FIGS. 4 and 6).

Figure 4:
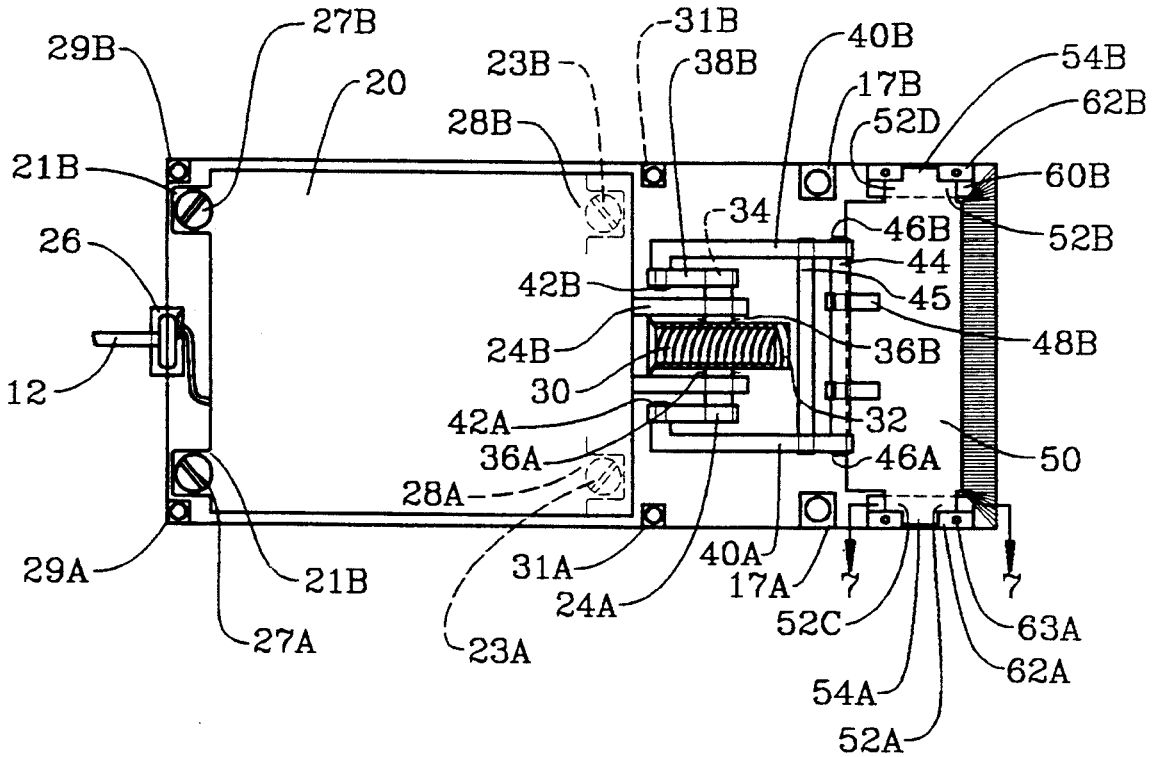
FIG. 4 is a sectional top view of the first embodiment of the invention.

Motor cover 11, which may be made of the same material as housing 10, is connected to housing 10 with screws 15 that are screwed into motor cover mounts 29A, 29B, 31A and 31B (FIG. 4). Motor cover 11 is approximately 60 mm wide and 108 mm long, with a bend approximately 8 mm before the end that touches cover 16 which conforms to the tops of side walls 64A and 64B. Motor cover 11 is contiguous to the tops of rear wall 19, side walls 64A and 64B and the rear edge of cover 16. Cover screws 14A and 14B are approximately 12 mm in length with flat heads, which are approximately 8 mm in diameter and approximately 5 mm deep. Screws 14A and 14B are located approximately 25 mm up from the front edge of cover 16 and are on the outermost edges of cover 16.

FIG. 2 shows an open view of the right side of the first embodiment of the invention. A power switch 26 is connected to a power source 12 and a motor 20 by wires 13. Switch 16 and source 12 are both located on rear wall 19, away from the area to be gripped by the user's hand.

Motor 20 may be either AC or DC, is approximately 77 mm long, 50 mm high and 57 mm wide. A worm gear 30 extends out of the middle of the end of motor 20 that faces front wall 64C. Motor 20 turns worm gear 30 which is approximately 25 mm long and 6 mm in diameter. Worm gear 30 is located directly above a brush drive gear 32 and rests on and engages drive gear 32 causing it to turn. Drive gear 32 is made of either a durable synthetic material or metal and is approximately 25 mm in diameter and 4 mm in width. Drive gear 32 is substantially perpendicular to horizontal plane 18 and front wall 64C, and is connected to an axle 34 which runs through the center of the drive gear 32 and is substantially parallel to horizontal plane 18 and front wall 64C. Axle 34 passes through posts 24A and 24B (FIG. 4) and is connected perpendicularly to drive rod cams 38A and 38B (FIG. 4).

Cams 38A and 38B are approximately 16 mm long, approximately 8 mm wide, and approximately 3 mm deep. Axle 34 is fixedly connected to cams 38A and 38B approximately 3 mm from the end of cams 38A and 38B.

Drive rods 40A and 40B (FIG. 4) are approximately 38 mm long, approximately 3 mm wide and have 90° bends at one end that are approximately 10 mm long terminating in drive rod axles which pass through apertures at the ends of cams 38A and 38B distal to axle 34. Drive rods 40A and 40B are rotatably connected to the other ends of cams 38A and 38B with retaining clips 42A and 42B (FIG. 4) or other suitable connectors, e.g., cotter pins. The opposite ends of drive rods 40A and 40B are connected perpendicularly to the ends of a brush rod 44 which passes through the ends of drive rods 40A and 40B distal to cams 38A and 38B. Drive rods 40A and 40B are rotatably fastened to brush rod 44 with retaining clips 46A and 46B (FIG. 4). Brush rod 44 spins freely while connected to drive rods 40A and 40B. Brush rod 44 connects to brush rod brackets 48A and 48B (FIG. 4), is parallel to brush 50 and perpendicular to brackets 48A and 48B.

As will readily be appreciated from FIGS. 2 and 4, worm gear 30 rotates drive gear 32, axle 34 and drive rod cams 38A and 38B all rotate as well in the manner of a crank mechanism. Starting from the position shown in FIG. 2, during the first 180° of rotation of drive gear 32 drive rod cams 38A and 38B cause the ends of drive rods 40A and 40B connected to brush rod 44 to move toward front wall 64C. During the second 180° of rotation of drive gear 32 cams 38A and 38B cause the ends of drive rods 40A and 40B connected to brush rod 44 to return back to the position shown in FIG. 2. Because brush rod 44 is connected to brush rod brackets 48A and 48B, brush 50 is caused to make a partial rotation in the clockwise direction during the during the first 180° of rotation of drive gear 32 and then to reverse direction and return to the position shown in FIG. 2 during the second 180° of rotation of drive gear 32.

As shown in FIGS. 2–6, brush 50 is illustrated as a cylindrical member which is approximately 25 mm in diameter, approximately 60 mm long, and mounted perpendicularly relative to front wall 64C. The cylindrical member is axially mounted to shafts 54A and 54B which protrude beyond the ends of the cylindrical member and define the cylindrical member axle. Integral with axle shafts 54A and 54B are lower brush cams 52A and 52B and upper cams 52C and 52D. As shown in FIGS. 3–6, cams 52A, 52B, 52C and 52C are intermediate between the cylindrical member and the end of shafts 54A and 54B. As shown, shafts 54A and 54B extend beyond the aforementioned cams to provide rotatable mounting of brush 50, as described below. In addition, brush 50 has a substantially triangular or teardrop shaped filament section 56. The pointed filament 56 faces downward and touches the lowest point of front wall 64C, inside housing 10, when filament 56 is in the furthest forward position shown in FIG. 2.

Brush 50, shafts 54A and 54B, and brush cams 52A and 52B are all one piece and made of a durable synthetic material, preferably one that can be molded or extruded.

Filaments 56 are impregnated into brush 50 for the entire length of brush 50 through tuft holes and will be made of either a metal or synthetic material. Brass has been found to be a sufficiently soft and flexible material to achieve the desired results without scratching glass. Appropriate synthetic materials include silicon carbide grit, nylon, and polypropylene. Filament 56 will form the pointed side of brush 50 and will be shaped like a triangle, with filaments extending from the tip of the teardrop back on the outermost parts of the brush 50 cylinder walls (see FIGS. 4–6) and conforming to the shape of brush 50 (see FIG. 2). Malish Brush and Specialty Company located in Willoughby, Ohio can produce such a brush.

Referring particularly to FIGS. 2 and 3, it can be seen that, as brush 50 rotates clockwise (FIG. 2), the extreme tip of the teardrop portion of the brush would ordinarily follow an arcuate path, a portion of which would extend below plane 18. Such a path of travel would be undesirable since, if the tip portion contacts the glass in the position shown in FIG. 2, at the mid-point of rotation of brush 50 the filaments would be pressed very hard against the glass and would scratch and mar the glass. One alternative would be to have the optimum pressure of the filaments against the glass occur at the mid-point of the rotation of brush 50, but this would mean that the filaments would not contact the glass in the forward-most filament position. This result would likewise be unacceptable, since paint closely adjacent to the mullions would not be removed.

In order to maintain constant pressure of the filaments against the surface during the entire path of rotational movement of brush 50, in accordance with the invention cams 52A and 52B cam against lower cam guides 60A and 60B and urge brush 50 away from plane 18 during the center portion of the rotation of brush 50. Because brush axle shafts 54A and 54B are mounted in slots 70 perpendicular to plane 18 (FIG. 3B), brush 50 is caused to rise away from plane 18 as cams 52A, 52B cam against cam guides 60A, 60B. Cams 52A, 52B are configured so that brush 50 is gradually urged away from surface 18 until the mid-point of brush rotation in either direction, thereby maintaining the tip of filaments 56 against the glass with substantially the same pressure at all brush positions throughout the brush rotation. In order to assure that brush shafts 54A and 54B return to their original positions at the bottom of the slot as rotation continues past the mid-point of the brush rotation, upper cams 52C and 52D engage upper cam guides 58A and 58B to urge the brush shafts 54A and 54B and, hence, brush 50 (including the teardrop portion) downward. Thus, after the rotating brush passes the peak engagement of cams 52A and 52B with lower cam guides 60A and 60B, during continued rotation of the brush engagement of cams 52C and 52D with upper cam guides 58A and 58B urges brush 50 downward. As will also be appreciated, the configuration of the upper cam guides means that the upper cams and cam guides also act as a stop or limit on upward motion of the brush under the action of the lower cams and cam guides. Thus, the upward and downward motion of brush 50 is well controlled in both the up and down directions throughout the brush rotation.

As stated, brush shaft suppressors 22A and 22B are part of cover 16, and extend downward parallel to side walls 64A and 64B and abut the lower cam guides 60A and 60B (FIG. 5), and the tops of shaft guides 62A and 62B. Supressors 22A and 22B are approximately 25 mm wide, 38 mm long and 5 mm deep. Suppressors 22A, 22B together with shaft guides 62A, 62B define the vertical slots 70 which receive axle shafts 54A, 54B. The bottom of suppressors 22A also define upper cam guides 58A, 58B.

The upper cam guides are semicircular cutouts in the bottom part of the inside half of each suppressor. The radius of the semicircle is approximately 4.5 mm. Also, there is a triangular shape cutout 68, approximately 1 mm in length on each of the rear sides of the slots. The cutout is contiguous to and located at the bottom of upper cam guides 58A and 58B on the side of upper cam guides 58A and 58B that are the closest to motor 20.

Pins 61A, approximately 1.5 mm in both diameter and length, extend horizontally from the bottom of suppressors 22A and 22B and connect and align suppressors 22A and 22B to shaft guides 62A and 62B.

Figure 3A:
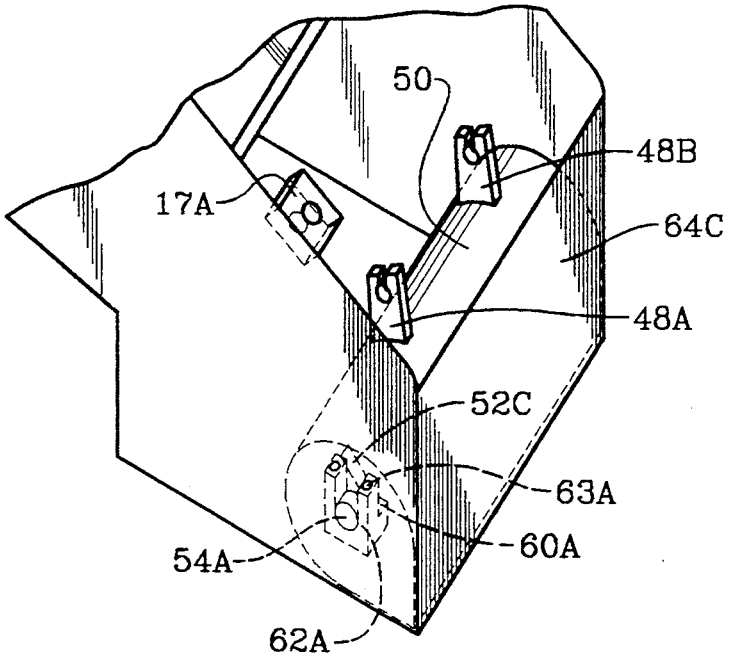
FIG. 3A is a front partial perspective view of the first embodiment of the invention with the brush cover removed and certain parts illustrated in phantom.

FIG. 3A is a front side view with cover 16 removed. Shaft guides 62A and 62B and lower cam guides 60A and 60B are a part of the inside wall of the housing 10 are manufactured as part of housing 10. Each shaft guide 62A and 62B consists of a base section and two parallel walls running parallel to the front wall 64C. The parallel walls are each approximately 6 mm wide, 2.5 mm deep and 9 mm long. The distance between the walls is approximately 6 mm and defines the lower portion of slot 70 (see FIG. 3B) to receive axle shafts 54A, 54B. The shaft guide walls begin approximately 6 mm from front wall 64C and approximately 10 mm from the bottom of side walls 64A and 64B. The walls form a "U" shape at the bottom thereof and are perpendicular to cam guides 60A and 60B. Lower cam guides 60A and 60B are approximately 19 mm long, 5 mm deep and 5 mm wide.

Pin holes 63A are approximately 1.6 mm in both depth and diameter are located in the center and at the tops of shaft guides 62A and 62B. Pin holes 63A receive pins 61A to align shaft suppressors 22A, 22B with lower cam guides 60A, 60B.

Brackets 48A and 48B are connected to brush rod 44 and are part of brush 50. Brackets 48A and 48B are manufactured as a part of brush 50 and are approximately 7 mm wide, 11 mm high, 3 mm deep and are located approximately 19 mm in from each end of brush 50. Brackets 48A and 48B are perpendicular to brush 50, are located on the opposite side of brush 50 from filament 56 and are angled back toward motor 20. Brackets 48A and 48B have openings at the top parallel to brush 50, which are approximately 2.8 mm wide and lead down approximately 3 mm to a cutout circle that is approximately 3 mm in diameter.

Figure 3B:
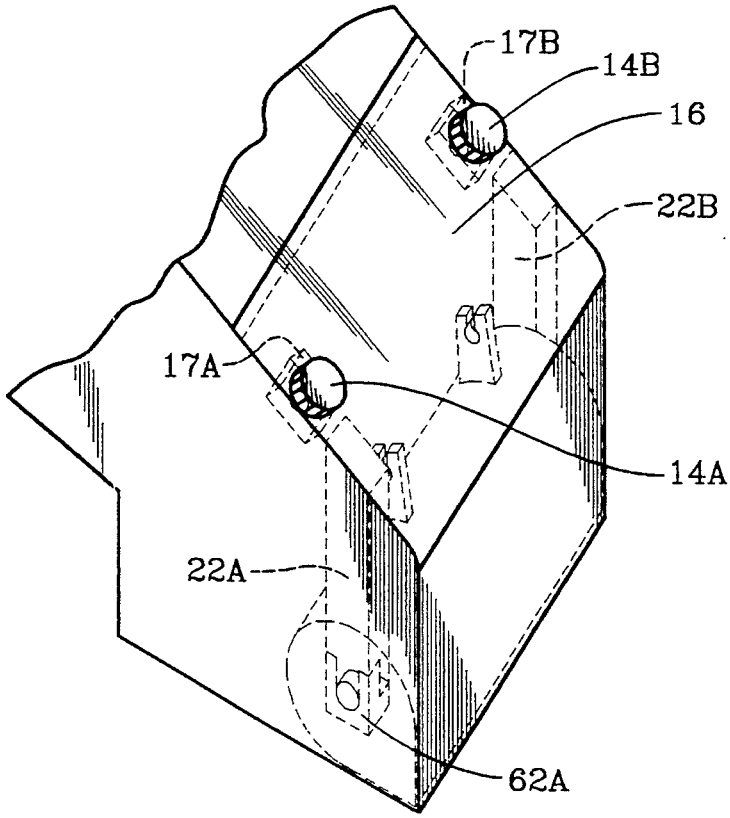
FIG. 3B is a front partial perspective view of the first embodiment of the invention with the brush cover attached and certain parts illustrated in phantom.

FIG. 3B is a front right side view with cover 16 attached. Cover screws 14A and 14B pass through cover 11 and are connected to housing 10 screw mounts 17A and 17B. Screw mounts 17A and 17B are approximately 8 mm wide, 8 mm long, 6 mm deep and molded to side walls 64A and 64B inside housing 10.

FIG. 4 is an open top view. Motor mount screws 27A, 27B, 23A, and 23B placed through motor mounts 21A, 21B, 28A and 28B connect motor 20 to housing 10. Motor cover mounts 29A, 29B, 31A and 31B are a part of housing 10 and have threaded screw holes. Washers 36A and 36B are located on axle 34 between posts 24A and 24B and drive gear 32. Posts 24A and 24B are made of metal, are perpendicular to axle 34, and are connected to motor 20 with screws. Posts 24A and 24B also form front motor mounts 28A and 28B. A support bar 45 is perpendicular to and connected to drive rods 40A and 40B. Support bar 45 and brush rod 44 are both approximately 38 mm long and approximately 3.8 mm thick. Drive rods 40A and 40B, cams 38A and 38B, axle 34, support bar 45, and brush rod 44 may be made of either metal or a synthetic material.

FIG. 5 is a bottom view. The thickness of the material of housing 10, cover 16 and motor cover 11 preferably is about 2 mm when the housing is made of metal or molded of rigid plastic. However, the thickness of the lower 10 mm of front wall 64C for the entire length of front wall 64C will be approximately 1 mm thick in order to allow filaments 50 to contact the window pane closely adjacent the mullion.

Bottom 66 will be open (without a bottom area) exposing brush 50, for the width of bottom 66 from side walls 64A to 64B, for a distance of about 25 mm from front wall 64C toward rear wall 19.

FIG. 6 is an open front view. At the ends of brush 50, filament 56 comes down on approximately a 15° angle toward the lowest area of side walls 64A and 64B and makes contact with glass surface 18 where front wall 64C meets glass 18.

The manner of using the hand held automated window paint scraper is unlike any other method used to date, and will be described with reference to FIGS. 1-7.

The scraper is held in either the left or right hand in such a manner that four fingers are on one side of housing 10 and the thumb is on the other side of housing 10. Motor cover 11 should be against the palm of the hand and power cord 12 will run under the wrist facing toward the forearm.

The scraper is turned on with power switch 26 and placed against glass 18 so that the front part of bottom 66 is parallel and touching glass 18. In this manner the bottom edges of front wall 64C and side walls 64A, 64B define the reference plane of the work surface to be acted upon by the brush. The scraper will also have side wall 64A or 64B parallel to and touching a window mullion. The scraper will then be moved along glass 18 and a window mullion to remove the dried paint on glass 18. The scraper will be moved along the mullion until it reaches a mullion perpendicular to the mullion it is against and then the scraper will be turned to move along another mullion. The side, rear, and front walls of housing 10 are all smooth and have no sharp edges that could cut or scrape the mullion.

When the power switch is turned on motor 20 turns worm gear 30, which turns drive gear 32, which turns cams 38A and 38B, which move drive rods 40A and 40B back and forth, causing brush 50 to move back and forth. When cams 38A and 38B turn 180° drive rods 40A and 40B move forward and when cams 38A and 38B turn the next 180° drive rods 40A and 40B move backward. This movement causes brush 50 to move back and forth. Drive rods 40A and 40B move approximately 24 mm in each direction.

Referring now to FIGS. 7A-7D, which are partial cross-section views along lines 7—7 of FIG. 4 illustrating brush 50 in various positions of rotation, the relative positions of the upper and lower cams and the upper and lower cam guides are shown.

Figure 7A:
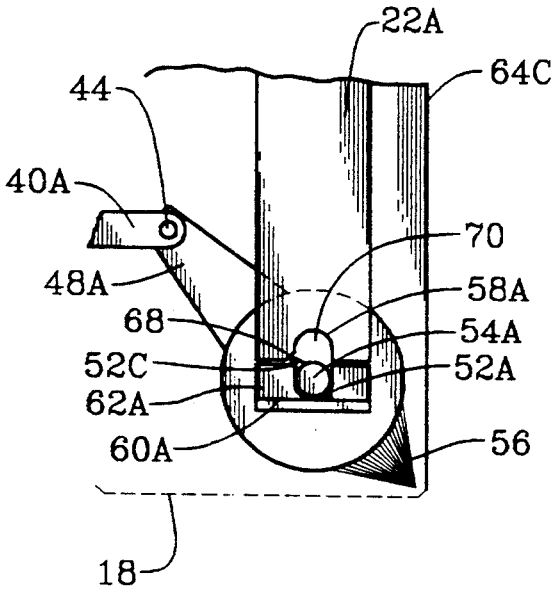
FIGS. 7A–7D are partial sectional views taken along lines 7—7 of FIG. 4 illustrating the position of the brush, including cams and camming surfaces during rotation of the brush across a surface.

FIG. 7A shows brush 50 in the initial, forward-most position illustrated in FIG. 2, with drive rod 40A, brush rod 44 and, hence, brush rod bracket 48A drawn toward motor 20. In this position, brush filaments 56 are disposed adjacent front wall 64C with the tip of the filaments slightly elevated from surface 18. As can be seen, in the preferred embodiment upper cam 52C is disposed within triangular cut-out 68 of upper cam guide 58A, and shaft 54A is disposed at the bottom of slot 70. As drive rod 40A begins to urge bracket 48A and, hence, brush 50 in a clockwise direction, upper cam 52C engages the surface of triangular cutout 68 and urges filaments 56 downward approximately 1.5 mm against the glass immediately adjacent to front wall 64C. In this manner filaments 56 act to begin scraping dried paint from the glass very close to front wall 64C, with the thickness of front wall 64C defining the width of the strip where paint is left on the window immediately adjacent the mullion.

Figure 7B:
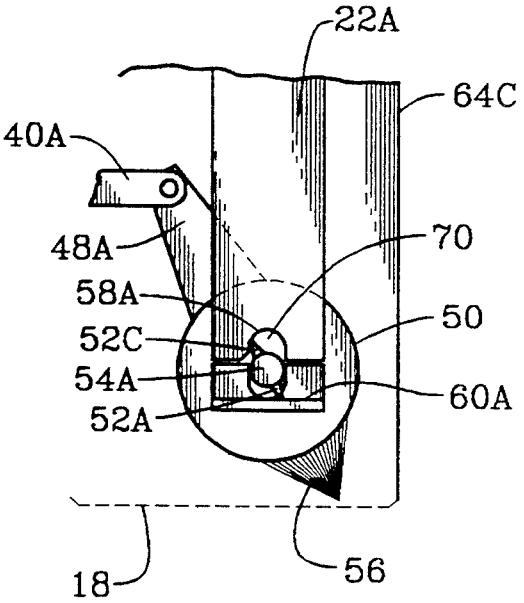

Referring now to FIG. 7B, as drive rod 40A continues to drive bracket 48A and brush 50 in as clockwise direction lower cam 52A engages and is cammed by lower cam guide surface 60A. Contact of lower cams 52A, 52B with lower cam guides 60A, 60B commences after the point when triangular cutout 68 has urged the filaments downward into contact with the work surface. Because lower cam 52A is integral with axle shaft 54A, and because the axle shaft is restricted to up and down motion within slot 70, the camming action of lower cam 52A against surface 60A causes axle shaft 54A to travel upward within slot 70, thereby raising brush 50 away from surface 18. At the same time, however, upper cam 52C engages upper cam guide 58A to limit the upward travel of the brush. As can be seen in FIG. 7B, the amount of upward travel of brush 50 is controlled by the upper and lower cams and guide surfaces such that the tip of filaments 56 always remains in the plane 18 of the window glass.

Figure 7C:
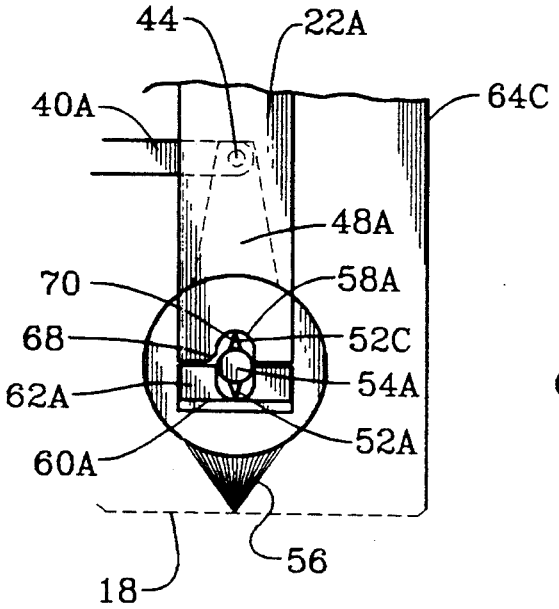

In FIG. 7C the brush has advanced to the mid-point of its sweep, with lower cam 52A having cammed axle shaft 54A and brush 50 to their maximum distance from plane 18 while still maintaining the tip of filaments 56 in contact with the window glass at plane 18. It will be noted that at the mid-point of the rotational sweep of brush 50 shown in FIG. 7C, upper cam 52C contacts the top of upper cam guide 58A. At the position shown in FIG. 7C the longitudinal axis of brush 50 has risen approximately 3 mm from the bottom-most position shown in FIG. 7A. As the brush continues to rotate in a clockwise direction from the position shown in FIG. 7C, camming engagement of upper cam 52C with upper cam guide 58A urges axle shaft 54A and brush 50 downward toward plane 18. Engagement of lower cam 52A with cam guide surface 60A to the left of slot 70 controls the descent of brush 50 so that the tip of filaments 56 remains in plane 18 during continued clockwise rotation of the brush.

Figure 7D:
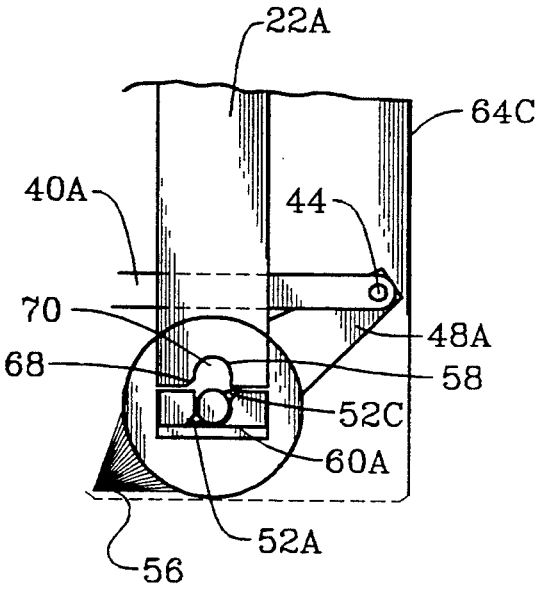

FIG. 7D shows drive rod 40A fully extended away from the motor with bracket 48A and brush 50 rotated to the end point of the clockwise sweep of the brush.

As will be appreciated, the positions of brush 50 shown in FIGS. 7A–7D correspond to the first 180° of rotation of drive gear 32 (see FIG. 2). During the second 180° of rotation of drive gear 32 drive rod 40A is drawn back toward motor 20, and the motion of brush 50 is reversed from the position shown in FIG. 7D to the position shown in FIG. 7A. When brush 50 rotates counterclockwise, lower cam 52A engages lower cam guide 60A in a left to right manner to cam axle shaft 54A upward in slot 70 so that brush 50 rises away from plane 18. Simultaneously, upper cam 52C engages upper cam guide 58A to control the ascent of brush 50 to the mid-point of the sweep (FIG. 7C), and thereafter urges the brush downward until the original position shown in FIG. 7A is reached.

The camming action of cams 52A, 52B, 52C, 52D against cam guides 60A, 60B, 58A, 58B cause filament 56 to apply the same pressure to glass 18 at each point that filament 56 touches against glass 18 across the entire sweep of the filaments across the glass at a constant distance of approximately 1.5 mm above the glass throughout the pass.

Generally speaking, the action of lower cams 52A, 52B against lower cam guides 60A, 60B control the distance of the filaments from the glass and the action of upper cams 52C, 52D camming against upper cam guides 58A, 58B cause filament 56 to maintain constant pressure on glass 18 as filament 56 passes over the glass by preventing filament 56 from raising to soon as brush 50 is pushed back and forth and as cam ends 53A and 54B contact lower cam guides 60A and 60B.

Brush shaft guides 62A and 62B enable brush 50 via shafts 54A and 54B to revolve back and forth and move up and down at the same time, while maintaining control and a parallel position to bottom 66 at all times.

Filament 56 preferably is made of either a synthetic or metal material which is sufficiently stiff to remove dried paint from glass 18 but, conversely, is soft enough that it will not mar the glass. A preferred metal which demonstrates these properties is brass, and the preferred diameter of individual brass filaments is on the order of about 1 mm. The synthetic materials could be made of silicon carbide grit, nylon, polypropylene, or some other synthetic material.

As filament 56 moves rapidly back and forth, and passes over and against glass 18, dried paint and other unwanted materials will be scratched off by filament 56. When the scraper is being operated, filament 56 will touch the lower areas of front wall 64 and side walls 64A and 64B at the same time that filament 56 is touching the areas of glass surface 18 inside housing 10 that are closest to front wall 64C and side walls 64A and 64B. The thickness of the bottom portion of front wall 64C and side walls 64A and 64B is approximately 1 mm, enabling filament 56 to remove dried paint and other unwanted materials adhering to the glass 18 that are as close as 1 mm from the window mullion. Leaving approximately 1 mm of paint on glass 18 adjacent the mullion desirably provides a seal between the window mullion and glass 18.

Filament 56 touches glass 18 through the open area of bottom 66 of housing 10, which is approximately 60 mm wide and 25 mm long. The open area extends 25 mm back from front wall 64C encompassing all the area between side walls 64A and 64B. Filament 56 moves back and forth, from front wall 64C toward rear wall 19 in this open area removing the dried paint as it passes.

Brush 50 is inserted into housing 10 by removing cover 16, lifting brush rod 44 and dropping brush 50 with the pointed end of the teardrop shaped portion facing down into housing 10, with the longitudinal axis of brush 50 parallel to front wall 64C. Shafts 54A and 54B fit into slot 70 of shaft guides 62A and 62B with brackets 48A and 48B pointing back toward motor 20. Brush rod 44 is then snapped into brackets 48A and 48B. Brush rod 44 revolves freely where it is connected to drive rods 40A and 40B thus reducing any friction when the scraper is operating. Brush rod 44 fits snugly into brackets 48A and 48B and does not revolve freely. Cover 16 is placed back on housing 10 and screwed into place with cover screws 14A and 14B, thus completing the process of inserting brush 50 into housing 10.

Where cover 16 is placed on housing 10 upper shaft suppressors 22A and 22B about lower cam guides 60A and 60B, and the tops of shaft guides 62A and 62B. Also, pins 61A at the ends of shaft suppressors 22A and 22B fits into pin guides 63A that are located on the tops of shaft guides 62A and 62B, providing alignment and stability so that slot 70 and the upper and lower cam guide surfaces are properly defined and positioned.

The back part of the scraper is raised to allow the scraper to move over mullions allowing the front part of bottom 66 to remain flat against and in contact with glass 18.

Figure 8:
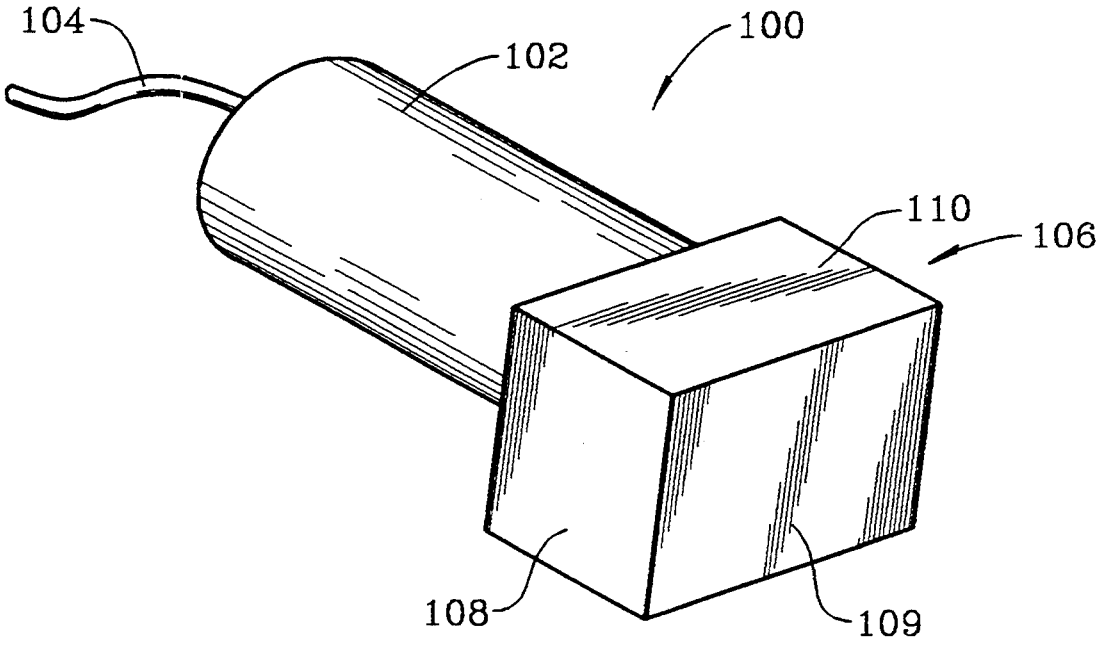
FIG. 8 is a front perspective view of a second embodiment of the invention.

A second embodiment of the invention is shown in FIGS. 8–14C. FIG. 8 is a perspective view of the automated window scraper 100 in accordance with the second embodiment, showing motor housing 102 connected to power cord 104 and a scraper brush housing 106. Housing 102 provides a hand grip for holding the scraper during use, and houses a motor for driving the scraper brush. Scraper housing 106 includes a front wall 108 and a left side wall 109. Scraper housing 106 also has a top 110 and a right side wall and rear side wall, neither of which are visible in FIG. 8.

Figure 9:
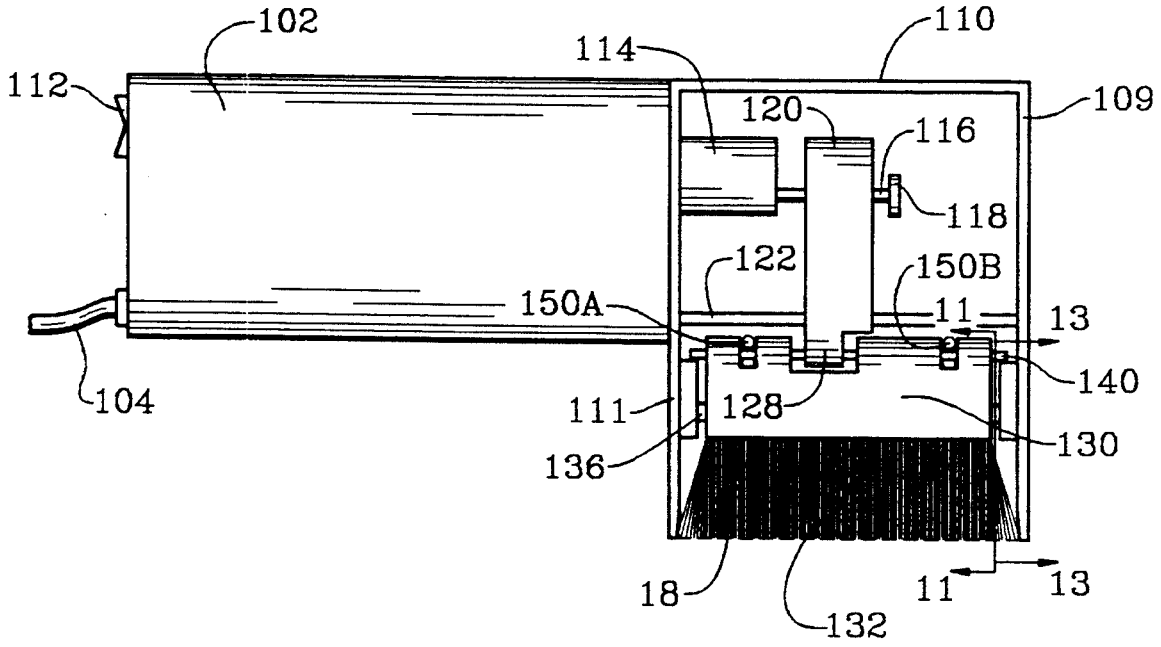
FIG. 9 is a front view of the embodiment illustrated in FIG. 8 with the front wall removed.

FIG. 9 is a front view of scraper 100 with front wall 108 removed. As shown, a power switch 112 is disposed at the end of motor housing 102 for turning the scraper on and off. The motor within housing 102 rotates drive shaft 114 at relatively high speed, on the order of about 2500 rpm. A cam shaft 116 having a cam shaft head 118 is mounted to drive shaft 114 off-center such that, as drive shaft 114 rotates, cam shaft 116 follows an eccentric path of rotation. A brush lever arm 120 is rotatably mounted about pivot rod 122 which is fixedly mounted to left side wall 109 and right side wall 111. Cam shaft 116 passes through a cam slot 124 (see FIGS. 11A–11C) on the motor portion 126 of the lever arm. The opposite end of the lever arm is rotatably connected to the upper portion of the scraper brush 130. As shown, brush 130 has filaments 132 extending downwardly therefrom toward plane 18, which represents the surface of the glass window pane. As shown, the bottom of side walls 109, 111 are tapered so that the bottom of each wall is approximately 1 mm thick, with filaments 132 extending outwardly at an angle from the brush to reach plane 18 at the bottom of the side walls. Preferably, front wall 108 similarly is tapered to allow the brush to contact the window pane closely adjacent the mullion.

Figure 10A:
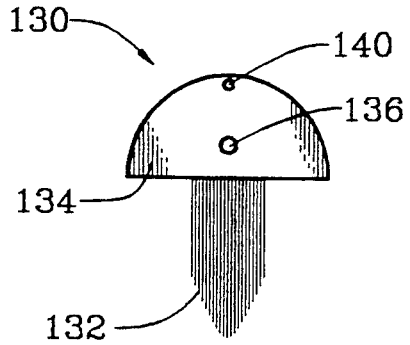
FIGS. 10A and 10B are side and front views, respectively, of the preferred brush in accordance with the second embodiment of the invention.
Figure 10B:
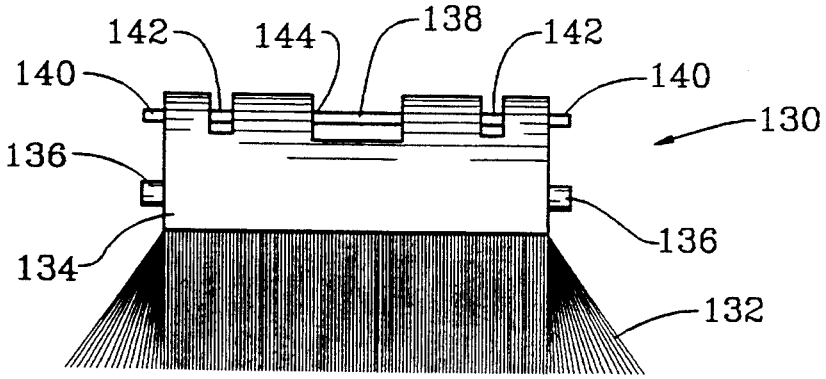

Referring now to FIGS. 10A–10B, brush 130 has brush body 134 which may be metal or plastic. Preferably, body 134 is molded of a high strength plastic such as polycarbonate. The bottom of the brush body has tuft holes (not shown) into which brush filaments 132 are secured to the brush body in a known manner, such as by bending tufts of filaments in half about staples driven into the brush body in the tuft holes. Preferably, such staples are inserted with the staple backspan parallel to the end faces of the brush body. Stapling the filaments to the body in this manner assures that the individual tips of the filaments will be tightly compacted next to one another along the length of the brush. Of course, other methods of securing the filaments to the brush body may also be used, such as gluing the filaments in place. As shown in FIG. 10A, the filaments preferably are trimmed so that the filaments along the longitudinal axis of the brush body extend the furthest from body 134, with filaments to either side being shortened so that the filaments taper from the front and back edges to the central filaments, as shown. Such shortened fibers provide support for the central filaments during use. At each end of brush body 134 are protruding axle pins 136 about which the brush can rotate. Axle pins 136 may comprise a metal axle rod extending through body 134, or, more preferably, are integrally molded as part of brush body 134. Brush 130 also includes a brush rod 138 extending through the upper portion of brush body 134. Preferably, brush rod 138 is a metal rod extending through brush body 134. Each end of brush rod 138 protrudes from the brush body to provide camming ends 140. As shown in FIG. 10B, spring channels 142 extend from the top edge of brush body 134 and may expose brush rod 138. In addition, a lever arm channel 144 extends from the top edge a distance sufficient to expose drive rod 138 for engagement with lever arm 120 in a manner to be described below.

Figure 11A:
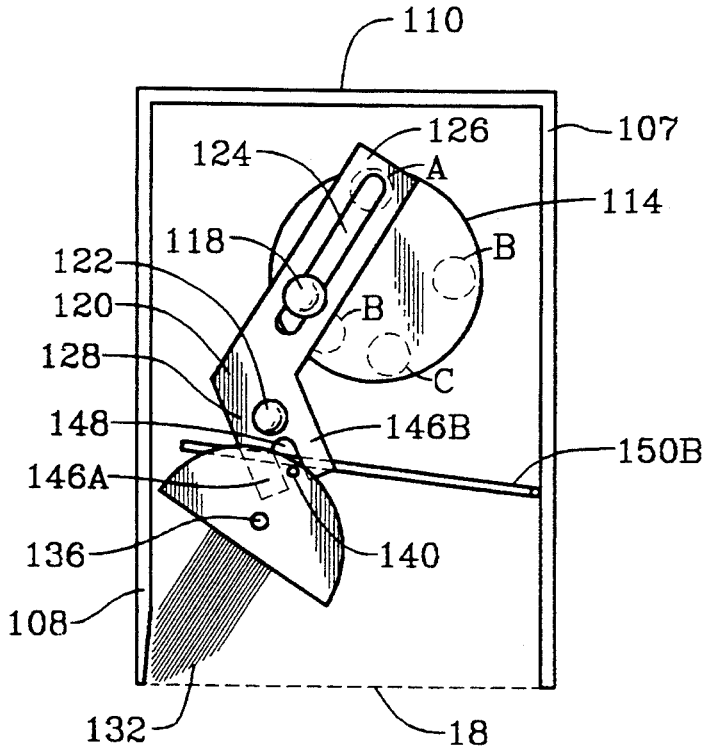
FIGS. 11A–11C are partial cross-section views taken along lines 11—11 of FIG. 9, illustrating the drive mechanism and brush in various positions during the sweep of the brush.
Figure 11B:
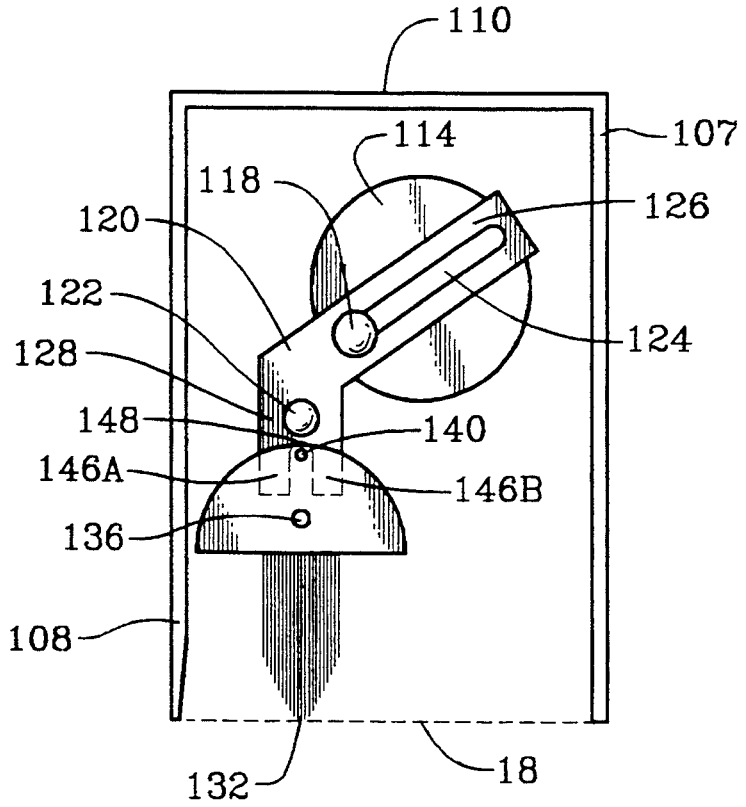
Figure 11C:
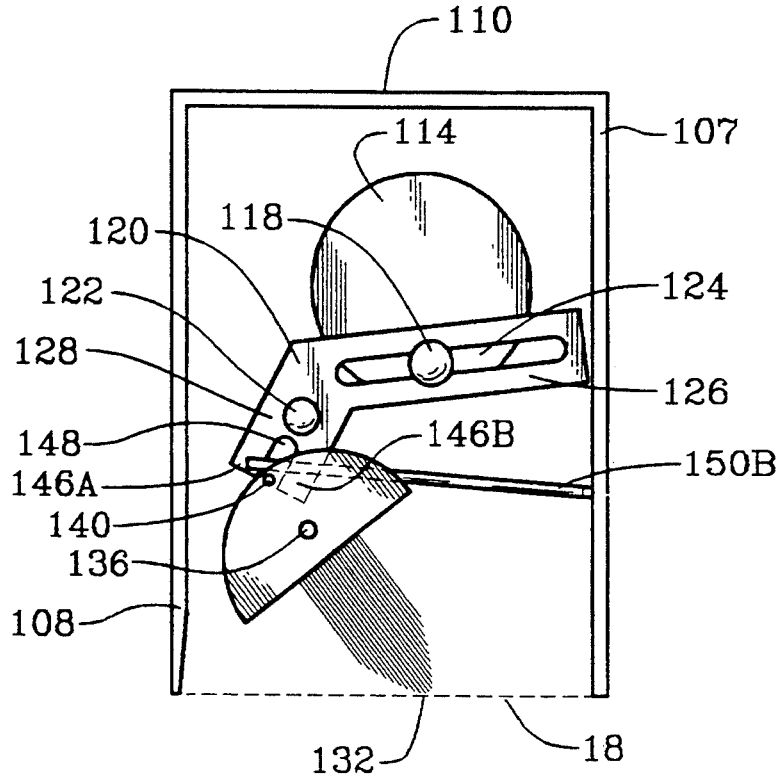
Figure 12A:
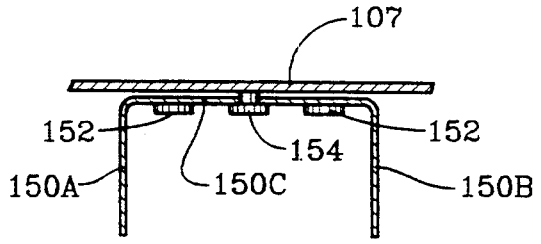
FIGS. 12A and 12B are partial top and front views of the preferred biasing spring mounted to the housing back wall.
Figure 12B:
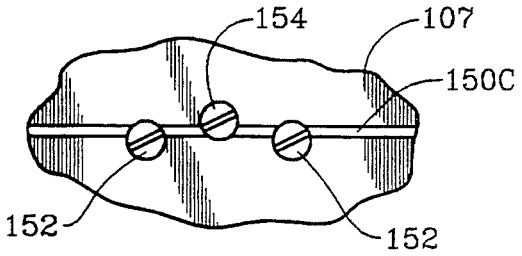

FIGS. 11A–11C are partial sectional views taken along lines 11—11 of FIG. 9, illustrating the drive mechanism, lever arm and brush with the brush in the forward-most, middle and rear-most brush positions, respectively. Referring now to FIG. 11A, lever arm 120 is rotatably mounted about pivot rod 122 with the cam shaft 116 extending from drive shaft 114 through slot 124 on motor arm portion 126. Cam shaft head 118 prevents the cam shaft from becoming dislodged from slot 124. As drive shaft 114 rotates, cam shaft 116 free to slide and rotate within slot 124. The brush arm portion 128 of the lever arm is on the side of pivot 122 opposite motor arm portion 126. Brush arm portion 128 optimally may have a reduced cross-section relative to the remainder of the lever arm (see FIG. 9). Brush arm portion 128 is configured to rotatably engage brush rod 138 while also permitting up and down sliding motion of brush rod 138 relative to brush arm portion 128. As shown in FIGS. 11A–11C, brush arm portion 128 preferably has two leg members 146A and 146B defining an open-ended slot 148 in brush arm portion 128. Slot 148 may have a U-shape, as shown, or other appropriate configuration for receiving and capturing rod 138. Of course, it is contemplated that slot 148 could also be closed at both ends, similar to slot 124 in the lever arm portion. Leaf spring members 150A and 150B are received within channels 142 (see FIGS. 9 and 10B) and exert a downward force on brush 130, thereby urging the brush toward the window pane. Leaf spring members 150A, 150B may comprise two legs of a generally U-shaped wire 150 having a backspan 150C from which legs 150A, 150B extend to engage the brush (see FIG. 12A). As shown in FIGS. 12A and 12B, the backspan may be fixed to rear wall 107 of the scraper housing, such as by mounting backspan 150C above the shafts of mounting screws 152 and below the shaft of screw 154. The screw heads secure the backspan to the back wall, and the mounting relationship of the backspan relative to the screw shafts resists flexing of the leg members or rotation of the backspan about its axis upon exertion of force on the leg members. As shown in FIG. 11A, backspan 150C should be fixed to rear wall 107 such that legs 150A, 150B are at all times flexed upward slightly to engage brush 130 and exert downward force thereon. As will be appreciated, backspan 150C could be fixed to rear wall 107 but alternative methods such as welding and the like. Similarly, the leaf spring may consist of more or less leg members in contact with brush 130 than shown. As yet a further alternative, the leaf spring may be replaced entirely by a compression spring mechanism, such as one or more compression springs engaging brush 130 and/or axle pins 136 directly or through an appropriate bushing. Likewise, torsion spring mechanisms are also contemplated and believed to be suitable.

Figure 13A:
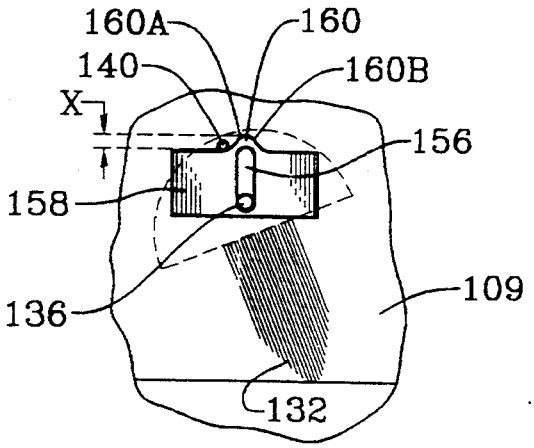
FIGS. 13A–13C are partial cross-section views taken along lines 13—13 of FIG. 9, showing the brush body in phantom for orientation purposes and illustrating the brush in various positions during the brush sweep corresponding to the positions shown in FIGS. 11A–11C, respectively, and further illustrating the camming of the brush away from the work surface during a portion of the brush sweep.
Figure 13B:
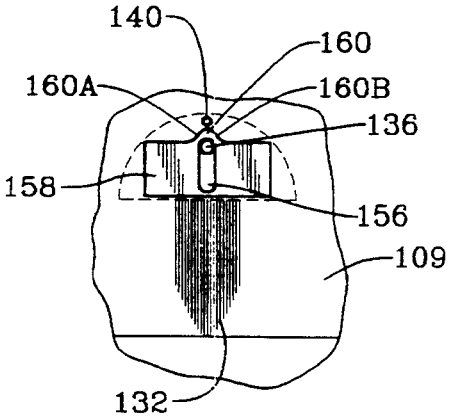
Figure 13C:
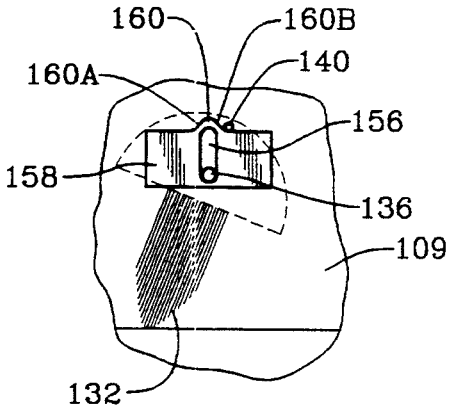

FIGS. 13A–13C are partial cross-sectional views taken along lines 13—13 of FIG. 9 illustrating various positions of the brush during the rotational sweeping motion. As shown, a vertical slot 156 in side wall 109, or, alternatively, in a mounting plate 158 fixed to side wall 109 receives axle pins 136. Mounting of pins 136 in slot 156 permits rotational motion of brush 130 about pins 136 and up and down movement of the brush relative to window pane 18 in a manner to be described below. Preferably, slot 156 is closed at both ends to limit and define the extreme up and down positions of the brush.

As shown in FIGS. 13A–13C, the upper surface of mounting plate 158 includes a cam 160. Cam 160 includes front cam surface 160A and rear cam surface 160B. The height "x" of cam 160 above the top surface of mounting plate 158 corresponds to the maximum distance the brush is to be raised above window pane 18 during the rotational sweep of the brush. As stated, in the preferred embodiment utilizing brass filaments to remove dried paint from windows, that distance will be approximately 3 mm and the height of cam 160 above the top surface of mounting plate 158 will be about 3 mm. Of course, this distance may vary for a given application. Camming ends 140 of brush rod 138 extend over and onto the top surface of mounting plate 158 and cam 160 at various positions during the rotational sweep of brush 130.

Figure 14A:
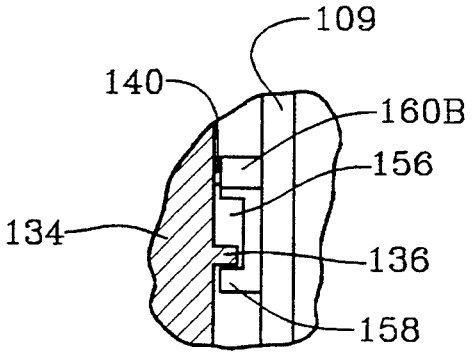
FIGS. 14A–14C are enlarged partial front views illustrating the position of the brush axle and brush cam relative to the housing, the positions corresponding to the positions shown in FIGS. 13A–13C, respectively.
Figure 14B:
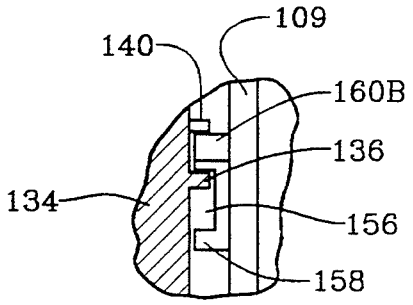
Figure 14C:
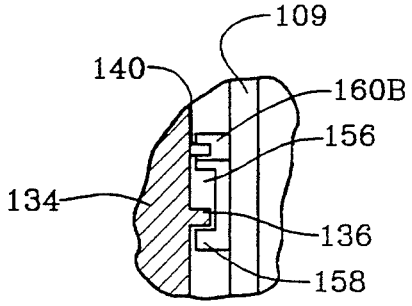

FIGS. 14A–14C correspond, respectively, to the positions shown in FIGS. 13A–13C. FIGS. 14A–14C are enlarged partial front views showing the engagement of pins 136 in slot 156 and the position of axle pins 136 and cam ends 140 within the slot and relative to cam 160, respectively. Thus, FIG. 14A corresponds to the brush position shown in FIG. 13A, FIG. 14B corresponds to the brush position shown in FIG. 13B, and FIG. 14C corresponds to the brush position shown in FIG. 13C.

In use, switch 112 is turned on to activate the motor and cause drive shaft 114 to rotate. As drive shaft 114 rotates, cam shaft 116 slides within slot 124 on lever arm 120. Starting from the position shown in FIG. 11A, the brush is in the position shown with brush rod 138 and cam ends 140 in the rear-most position and the brush filament tip in the forward-most position. As drive shaft 114 rotates in a counterclockwise direction cam shaft 116 slides within slot 124 and moves to positions "B", "C" and then back to position "A" in the sequence shown. Position "A" corresponds to the brush position shown in FIG. 11A. Position "B" corresponds to the vertical brush position shown in FIG. 11B and position "C" corresponds to the position shown in FIG. 11C with brush rod 138 and cam ends 140 in the forward-most position and the brush filament tip in the rear-most position. Thus, one complete rotation of drive shaft 114 rotates brush 130 about the axis of pins 136 from the position shown in FIG. 11A with the filament tips in the forward-most position, through the position shown in FIG. 11B with the filaments substantially vertical, to the position shown in FIG. 11C with the filament tips in their rearward-most position, and back through the position shown in FIG. 11B to the position shown in FIG. 11A.

Referring now to FIGS. 13A–13C and 14A–14C, corresponding to the brush and lever arm positions shown in FIGS. 11A–11C, respectively, the motion of the brush up and down relative to window pane 18 will now be explained. As shown in FIGS. 13A and 14A, when brush 130 is in the position shown in FIG. 11A, cam pin 140 rests on top of mounting plate 158 to the rear side of cam 160, with pins 136 disposed at the bottom of slot 156. This position corresponds to the brush and lever arm position shown in FIG. 11A. As drive shaft 114 rotates brush 130 is rotated toward the position shown in FIG. 11B. As brush 130 rotates about pins 136, cam ends 140 ride up on cam surface 160A until cam end 140 is disposed atop the cam, as shown in FIGS. 13B and 14B. Camming the cam ends in this manner causes pins 136 to move upward in slot 156 away from surface 18 against the spring legs 150A, 150B (see FIGS. 9 and 11A–11B). Referring now to FIGS. 13C and 14C, further rotation of the brush about pins 136 cause cam ends 140 to ride down cam surface 150B, permitting the brush to gradually return under the force of leaf spring legs 150A, 150B to the lowermost position with pins 136 at the bottom of slot 156.

As with the first embodiment, rotating the brush about its axis while gradually camming the brush away from window pane 18 until the brush filaments are substantially vertical, and then returning the brush downward through the remaining working sweep of the brush maintains the filament tips in the same plane throughout the brush sweep, i.e., at a uniform distance, preferably about 1 mm, from the reference plane established by the front, back and side walls contacting and resting on a window pane 18. At the same time, the controlled vertical motion of the brush permits an arcuate sweeping motion of the brush which is required to effectively remove dried paint, while maintaining equal pressure of the filaments against the painted surface.

Accordingly, the reader will see that the automated window scraper of the present invention is far superior to the prior art razor blade method of removing paint from window panes and other glass surfaces. In addition to the speed, ease of use and convenience the automated window paint scraper substantially reduces the likelihood of personal injury, i.e., a razor blade cut, presents no danger to children if left out or accidentally stumbled upon by children, provides a consistently even edge around a window pane where paint has been removed since the scraper housing uses the mullion as a guide, advantageously cleans closely adjacent the mullion while simultaneously leaving a narrow strip of paint on the glass adjacent the mullion to provide a seal between the mullion and the glass. In addition, because of the ease with which paint now can be removed from glass adjacent mullions homeowners will be more likely to paint mullions, thereby more effectively maintaining their homes, decreasing energy costs due to poor seals at mullions, and generally maintaining their homes more properly. Because professional painters need not spend as much time either removing excess paint or being careful not to get paint on window glass in the first place, painting costs to the consumer will be reduced. The scraper enables the brush to pass over surfaces at an equal distance from the surfaces throughout the pass. Also, brushes can be changed to accommodate the different surfaces and substances to be removed thereof.

While the foregoing description contains many specifics, numerous variations will occur to those of ordinary skill in the art upon reading the description and working with the invention. By way of example only, the drive mechanism configurations of the various embodiments are readily interchangeable and it may be desirable to provide a transverse gear mechanism with the second embodiment in order to obtain the gripping configuration of the first embodiment. Additionally, it is contemplated that the scraper could be adapted as an attachment for an electric drill which would provide a cost effective motor power for rotational energy. Additionally, the scraper could be used for removing rust, old paint, varnish, shellac, and other unwanted substances from surfaces such as wood, e.g., hardwood floors, metal, brass, stone, slate, ceramic tile without damaging the surfaces.

It is further contemplated that those skilled in the art may configure the brush and drive mechanism to rotate the brush 360° while still camming the brush away from the work surface during the working portion of the brush rotation in order to obtain the benefits of the invention. It is also contemplated that the filament configuration and the precise path of travel followed by brush filaments may vary. In this regard, it may be desirable to slightly offset the brush in the forward direction in the forward-most position so that the initial motion of the filaments is downward as rotation of the brush commences but prior to engagement of the cam ends with the camming surface. It is contemplated that this may be accomplished by providing a small offset at the bottom of the slot in which the pins ride.

Accordingly, the scope of the invention should be determined by the appended claims and their equivalents, rather than by the detailed description set forth above.

What is claimed is:

1. An apparatus for removing substances from a surface comprising:

a housing having front and side walls defining a work area opening;

a brush disposed within said housing including a brush support with a plurality of filaments extending from a portion of said brush support toward said work area opening, said brush being mounted to said housing so as to be rotatable about an axis of rotation substantially perpendicular to said filaments, said axis of rotation being movable from a first position toward said work area opening to a second position away from said open work area;

biasing means for biasing said axis to said first position;

drive means connected to said brush for oscillating said brush about said axis; and camming means for moving said brush axis of rotation from said first position to said second position in opposition to said biasing means during a portion of each oscillation of said brush by said drive means, said filaments contacting a surface placed against said work area opening in both said first and second positions.

2. The apparatus of claim 1, wherein said filaments extending from a portion of said support are substantially pointed.

3. The apparatus of claim 1 wherein said support is substantially cylindrical and said filaments extend from a portion of said support in a radial direction relative to said support.

4. The apparatus of claim 1, wherein said filaments extend to the edges of said housing at said work area opening.

5. The apparatus of claim 1 wherein said filaments extend into the corners of said work area opening for removing substances from a corner of the work surface.

6. The apparatus of claim 1 wherein said filaments are made of a material selected from the group consisting of brass, silicon carbide grit, nylon, and polypropylene.

7. The apparatus of claim 1 wherein said drive means comprises:

at least one drive rod connected at a first end thereof to said brush support;

a drive gear connected to a second end of said drive rod, said drive gear moving said drive rod in a first direction during a portion of one rotation of said drive gear and a second, opposite direction during a second portion of one rotation of said drive gear.

8. The apparatus of claim 7 wherein said drive rod is connected at the second end thereof to a first end of a drive rod cam, the second end of said drive rod cam connected to an axle to which is mounted said drive gear.

9. The apparatus of claim 8 wherein said drive gear is connected to a drive a motor.

10. The apparatus of claim 1 wherein said drive means comprises:

a rotatable lever arm connected at a first end thereof to said brush and having a slot at a second portion thereof;

a cam shaft positioned in said slot and connected to a drive shaft.

11. The apparatus of claim 10 wherein said lever arm slot is in a drive portion of said lever arm, said lever arm rotatably engages a pivot, and said drive shaft drives said cam shaft in an eccentric path.

12. The apparatus of claim 1 wherein said camming means comprise at least one cam on said brush, said cam engaging a camming surface on said housing during a portion of oscillation of said brush.

13. The apparatus of claim 12 wherein said brush includes an axle which defines said axis of rotation, said axle mounted in a pair of slots in said housing, said slots being substantially perpendicular to said housing work area opening and said axle moving in said slots to move said axis of rotation from said first position to said second position in response to engagement of said cam with said camming surface.

14. The apparatus of claim 1 wherein said biasing means comprise a cam associated with said brush, said cam engaging a cam guide on said housing during a portion of said rotation of said brush.

15. The apparatus of claim 1 wherein said biasing means comprises a spring.

16. The apparatus of claim 1 wherein said brush includes an axial shaft which defines said axis of rotation, said axial shaft being mounted in a pair of slots in said housing, said slots being substantially perpendicular to said housing work area opening and said axial shaft moving in said slots to move said axis of rotation from said first position to said second position.

17. The apparatus of claim 1 wherein said filaments are made of brass.

18. An apparatus for removing substances from a surface comprising:

a brush having a brush support and a plurality of filaments extending from a surface of said support, a pair of axle pins extending longitudinally from opposite ends of said support, said brush having a longitudinal axis of rotation about said pins substantially perpendicular to said filaments, said support further including at least one brush support camming member;

a housing having front and side walls defining a work area opening, each said side wall having a brush axle pin receiving slot for receiving one of said brush axle pins, each slot extending substantially perpendicular to said work area opening, at least one of said side walls having a housing camming member, said housing enclosing said brush with said brush axle pins disposed in said brush axle pin receiving slots with said filaments extending toward said work area opening and said brush support camming member engaging said housing camming member;

biasing means for biasing said brush axle pins toward said work area opening;

drive means for oscillating said brush back and forth about said brush axle pins, said brush support camming member engaging said housing camming member to move said brush axle pins away from said work area opening in opposition to said biasing means during a portion of said oscillation, thereby causing said axis of rotation of said brush to move away from said work area opening as said axle pins move away from said work area opening in said slots.

19. The apparatus of claim 18 wherein said means for biasing said axis comprises a spring.

20. The apparatus of claim 18 wherein said filaments are made of brass.

21. An apparatus for removing substances from a surface comprising:

a housing having front and side walls with the bottom edges thereof defining a work area opening, each said side wall having a brush axle receiving slot extending substantially perpendicular to said side wall bottom edge;

a brush mounted within said housing, said brush having a brush body including a brush axle with opposite ends of said brush axle disposed in said side wall brush axle receiving slots, said brush being rotatable about said brush axle and said brush axle being movable within said brush axle receiving slots from a first axle position toward said side wall bottom edges to a second axle position away from said side wall bottom edges, said brush having a plurality of filaments extending therefrom toward said work area opening, said filaments extending substantially perpendicular to said brush axle, said brush assuming a first brush position with said filaments extending toward said front wall bottom edge with said brush axle in said first axle position and a second brush position with said filaments substantially perpendicular to said side wall bottom edges with said brush axle in said second axle position, the tips of said filaments extending substantially the same distance from said side wall bottom edges in said first and second positions;

biasing means for biasing said brush axle to said first axle position;

drive means connected to said brush for oscillating said brush back and forth about said axis; and camming means for moving said brush axle from said first axle position to said second axle position in opposition to said biasing means during a portion of each oscillation of said brush by said drive means.

22. The apparatus of claim 21 wherein said filaments are made of brass.

23. The apparatus of claim 21 wherein said camming means comprise at least one cam on said brush engaging a camming surface on said housing during a portion of said brush oscillation to move said brush axle.

24. The apparatus of claim 21 wherein said biasing means comprise a spring.

* * * * *